United States Patent [19]

Georgiev et al.

[11] 4,013,401

[45] Mar. 22, 1977

[54] APPARATUS FOR PREHEATING A RAW MATERIAL CHARGE FOR APPLICATION TO AN ELECTRIC FURNACE

[75] Inventors: Assen Yordanov Georgiev; Ivan Vassilev Genev, both of Sofia, Bulgaria

[73] Assignee: DSO "Cherna Metalurgia", Sofia, Bulgaria

[22] Filed: Sept. 18, 1975

[21] Appl. No.: 614,516

[52] U.S. Cl. ..... 432/164; 432/209; 432/95; 266/175; 266/901; 13/33; 13/2 R

[51] Int. Cl.[2] ..... F27B 3/04

[58] Field of Search ..... 432/14, 58, 73, 207, 432/209, 95, 128–130, 163, 164; 34/86, 174; 13/2, 33; 266/901, 175

[56] References Cited

UNITED STATES PATENTS

| | | | |
|---|---|---|---|
| 1,121,559 | 12/1914 | Heslewood | 266/15 |
| 2,493,218 | 1/1950 | Bergstrom | 34/174 |
| 2,607,666 | 8/1952 | Martin | 432/58 |
| 2,948,521 | 8/1960 | Heiligenstaedt | 432/14 |
| 2,996,292 | 8/1961 | Graf et al. | 432/14 |
| 3,163,520 | 12/1964 | Collin et al. | 13/33 |
| 3,598,888 | 8/1971 | Tada | 13/33 |
| 3,702,182 | 11/1972 | Leyshon | 13/2 |
| 3,789,126 | 1/1974 | Brusa | 13/33 |

FOREIGN PATENTS OR APPLICATIONS

| | | | |
|---|---|---|---|
| 4,994,594 | 9/1974 | Japan | 432/95 |

*Primary Examiner*—John J. Camby
*Assistant Examiner*—Henry C. Yuen

[57] ABSTRACT

An improved arrangement for preheating a charge of raw material, illustratively an alloying charge, with hot gases prior to application of such charge to a ferroalloying kiln or other electric furnace is described. The charge to be preheated is loaded into a main vertically disposed reservoir which communicates at its bottom end with a combustion chamber adapted to generate the hot gases for preheating. A perforated transition cylinder is vertically disposed within the combustion chamber. Hot gases flow into the interior of the transition cylinder through the apertures and are directed upwardly through the charge stored in the main reservoir, thereby effecting the desired preheating action. The gases emerging from the top of the main reservoir enter a smoke chamber, from which they are discharged into suitable scrubbing and ventilating facilities. The preheated charge is selectively introduced into the electric furnace from the main reservoir via the transition cylinder.

3 Claims, 3 Drawing Figures

APPARATUS FOR PREHEATING A RAW MATERIAL CHARGE FOR APPLICATION TO AN ELECTRIC FURNACE

BACKGROUND OF THE INVENTION

The invention relates to apparatus for preheating charges of raw material with hot gases prior to application of the charge to an electric furnace.

In the manufacture of ferroalloys and the like using electric furnaces, the iron to be alloyed is introduced into the furnace together with a charge of an alloying material in raw form, which has been pre-heated. The preheating operation is accomplished via the combustion of gases resulting from the operations in the electric furnace.

A separate rotary or shaft kiln is generally provided around the electric furnace for holding the charge and receiving the hot combustion gases for preheating. Additionally, an additional furnace is often provided in such systems for effecting the combustion of such gases prior to their introduction into the furnace-surrounding kiln.

Such systems have the disadvantage of being bulky, space-consuming, complicated and expensive, as well as requiring additional facilities for transporting the preheated charge from the kiln into the electric furnace. Additionally, the auxiliary kilns are inefficient and generate large amounts of dust.

SUMMARY OF THE INVENTION

These disadvantages are avoided in the improved apparatus constructed in accordance with the invention for preheating a charge of raw material.

Illustratively, the preheating facilities include a vertically disposed main charge-holding cylindrical reservoir having disposed at its upper end a smoke chamber and its lower end means for burning the gases evolving from the electric furnace. The combustion chamber has a vertical axis which is parallel to but displaced from the axis of the main reservoir.

An apertured transition cylinder is vertically disposed within the combustion chamber, and has its upper end in communication with an inwardly tapered bottom portion of the main reservoir. The bottom of the transition cylinder is coupled to the alloying charge input of the electric furnace.

The transition plate is provided with a plurality of apertures therethrough so that hot gases generated in the combustion chamber enter the interior of the transition cylinder and flow upwardly through the charge of raw material then disposed in the main reservoir to effect the preheating operation.

The charge acts as a filter for the upwardly flowing gases, which upon leaving the main reservoir enter the smoke chamber and are discharged to suitable residual scrubbing and ventilating means to complete the gas cleaning operation.

The so preheated charge in the main reservoir is then selectively coupled to the input of the electric furnace through the transition cylinder.

In addition to effecting an efficient filtering operation of the upwardly flowing preheating gases and thereby a low contamination output of the smoke chamber, the preheating facilities of the invention are relatively inexpensive, are compact in size and operate with gas temperatures that are desirably high (up to 900° C). In addition, it dispenses with the need of auxiliary kilns for effecting the preheating operation.

BRIEF DESCRIPTION OF THE DRAWING

The invention is further set forth in the following detailed description taken in conjunction with the appended drawing, in which.

DETAILED DESCRIPTION

Figure 1:
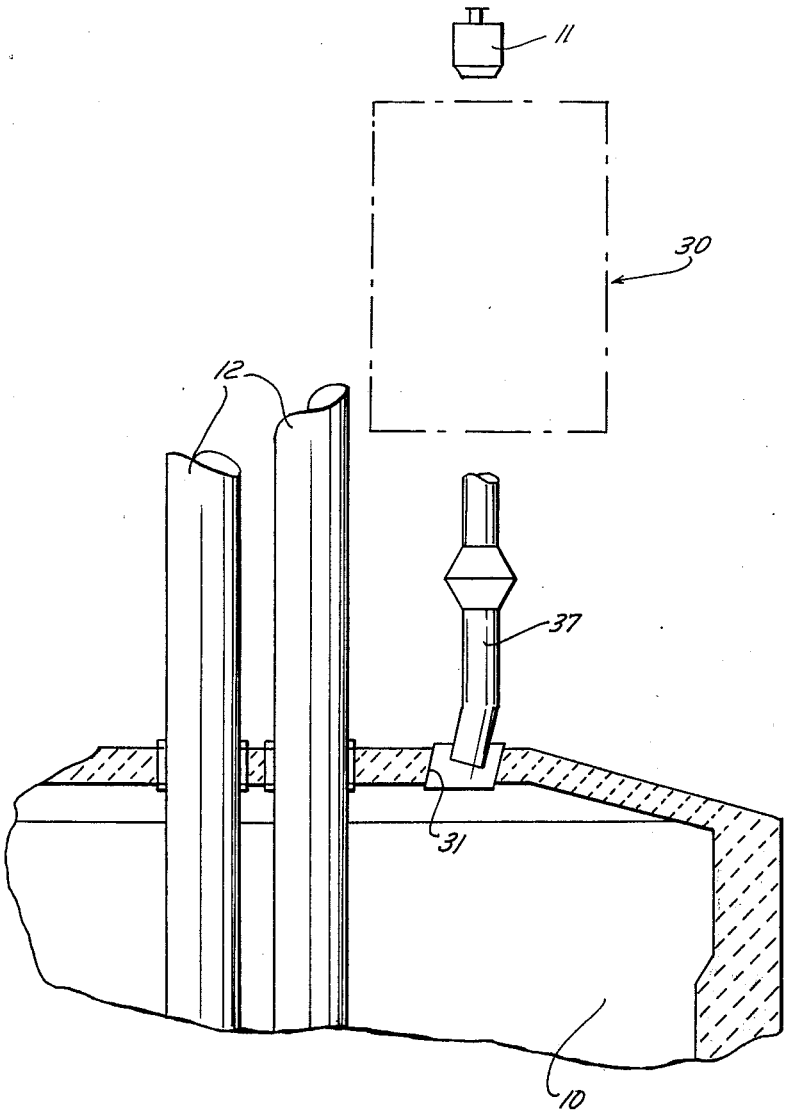
FIG. 1 is a schematic representation of an electric furnace, together with a charge-preheating apparatus associated therewith.
Figure 2:
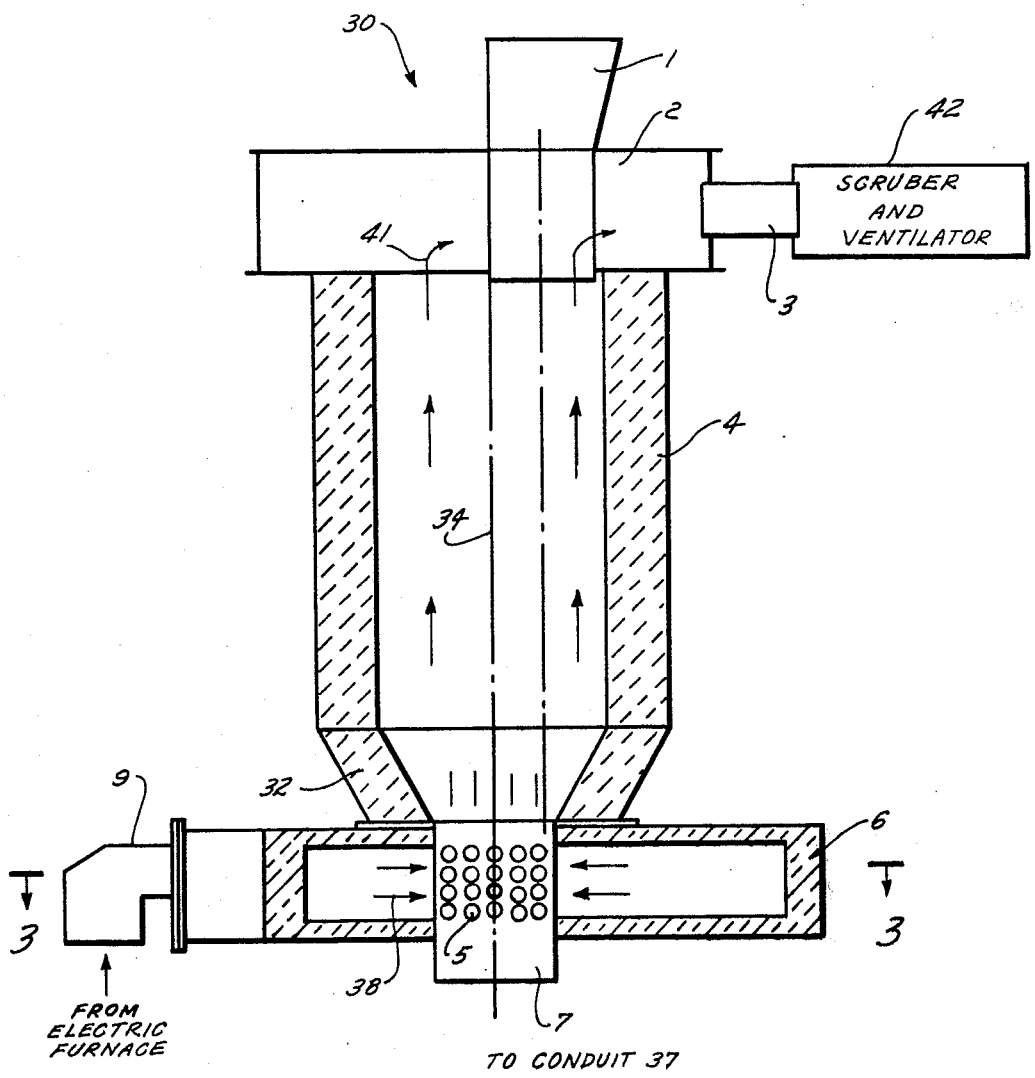
FIG. 2 is a vertical view, partially in section, of a charge-preheating apparatus constructed in accordance with the invention.

Referring now to the drawing, FIG. 1 illustrates a conventional carriage 11 which contains a batch of raw material (illustratively carbonate-manganese ore) in which an alloying material is to be extracted for use in an electric ferroalloy furnace 10 in a conventional manner. Such charge of raw material, after suitable processing in a charge-preheating apparatus 30 as described below, enters the furnace 10 via an input port 31. The ferrous material to be alloyed therewith is introduced through a separate port (not shown). The heating of the furnace 10 is accomplished in a conventional way via electrodes 12, 12. The raw charge in the batching carriage 11 is first fed into a receiving bunker 1, from which it is selectively dropped through a smoke chamber 2 to the interior of a generally cylindrical main charge reservoir 4. The bottom portion of the reservoir 4 is inwardly tapered as represented at 32.

Figure 3:
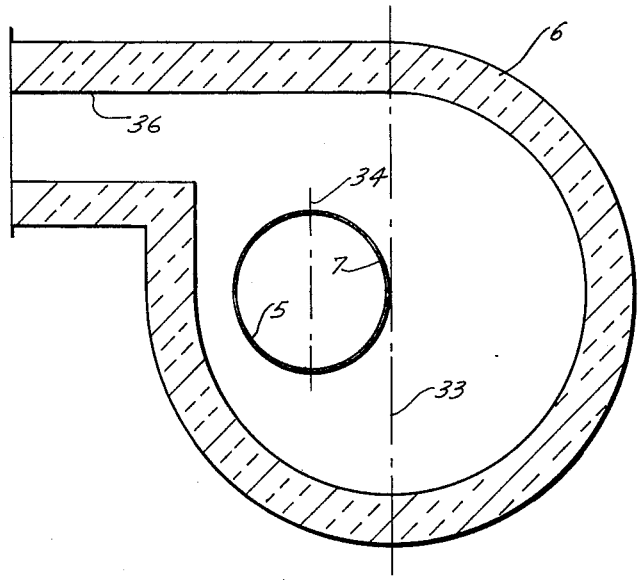
FIG. 3 is a view, partially broken-away, taken along line 3—3 of FIG. 2.

Disposed beneath and in communication with the reservoir 4 is a combustion chamber 6, which has a vertical axis 33 that is parallel to and offset from a vertical axis 34 of the reservoir 4. As shown best in FIG. 3, the chamber 6 is provided with a transverse extension 36 which terminates in a burner 9, which effects combustion of waste gases from the electric furnace 10 (FIG. 1) or from another suitable source. The gases heated by the burner 10 are employed for the preheating of the charge in the main reservoir 4.

For this purpose, the apparatus 30 is further provided with a vertically disposed transition cylinder 7 that is accommodated within the combustion chamber 6 as shown and that is provided on its peripheral wall with a plurality of apertures 5, 5 extending therethrough. The upper surface of the cylinder 7 communicates with the tapered lower portion 32 of the reservoir 5 while the lower end of the cylinder 7 is coupled to the input port 31 (FIG. 1) of the electric furnace 10 via a suitable conduit 37.

In the operation of the preheating apparatus 30, the gases heated by the burner 9 and present in the combustion chamber 6 flow into the interior of the cylinder 7 via the apertures 5, and are directed upwardly through the raw alloying charge then disposed in the main reservoir 4, as indicated by the arrows 38, 39. As a result, the charge in the reservoir 4 is preheated as desired.

After the hot gases leave the top of the charge, they are directed into the smoke chamber 2 as indicated by arrows 41, and from there are conducted out of the apparatus 30 via a conduit 3 into a suitable scrubbing and ventilating system 42. The system 42 completes the cleaning job of the gases, which had already been significantly cleaned by the filtering action occurring during their upward passage through the charge in the reservoir 4.

It will be understood that the preheating facilities of the invention are not limited to applications for the manufacture of ferroalloys, but can be employed in the manufacture of other materials, such as certain types of cast iron, anhydrous lime, dolomite, and the like.

Because of the compact arrangement of the described apparatus, together with the extremely high temperatures (up to 900° C) obtainable with the use of the combustion chamber 6 and the burner 9, the overall saving in power consumption of the apparatus for a given degree of preheating can range between 15 and 35%, depending upon the composition of the raw charge to be preheated.

In the foregoing, one illustrative embodiment of the invention has been described. Many variations and modifications will now occur to those skilled in the art. It is accordingly desired that the scope of the appended claims not be limited to the specific disclosure herein contained.

What is claimed is:

1. In an apparatus for preheating a charge of raw material with hot gases prior to application of the charge to an electric furnace, the apparatus comprising a main charge-holding cylindrical reservoir having a first vertical axis, a cylindrical combustion chamber having a second vertical axis, and conduit means effecting communication between the combustion chamber and the bottom of the main reservoir, the improvement wherein the combustion chamber is disposed below and adjacent the bottom end of the first reservoir with its second axis offset from and parallel to the first axis; wherein the conduit means comprises a vertically disposed transition cylinder extending through the combustion chamber coaxial with the first axis of the main reservoir and communicating at its upper end with the main reservoir, the transition cylinder having a plurality of apertures in its peripheral wall for conducting hot gases from the combustion chamber into the interior of the transition cylinder and thereafter to the lower end of the main reservoir through the upper end of the transition cylinder; and wherein the apparatus further comprises means for coupling the charge in the main reservoir to the furnace through the interior of the transition cylinder.

2. The improvement as defined in claim 1, further comprising a smoke chamber disposed above and in communication with the main reservoir, means for introducing the charge into the top of the main reservoir through the smoke chamber, and means for exhausting hot gases from the side of the smoke chamber.

3. The improvement as defined in claim 1, in which the main reservoir has an inwardly tapering bottom portion.

* * * * *